United States Patent [19]

Tanaka et al.

[11] Patent Number: 4,887,662

[45] Date of Patent: Dec. 19, 1989

[54] COOLING DRUM FOR CONTINUOUS-CASTING MACHINES FOR MANUFACTURING THIN METALLIC STRIP

[76] Inventors: Shigenori Tanaka, c/o R & D Laboratories-III, Nippon Steel Corporation, 1-1-1, Edamitsu, Yahatahigashi-ku, Kitakyusyu-shi, Fukuoka; Yasuo Itoh, Plant Engineering Technology Bureau, Nippon Steel Corporation, 1-1-1, Edamitsu, Yahatahigashi-ku, Kitakyusyu-shi, Fukuoka; Michiya Hayashida, c/o Sakai Works, Nippon Steel Corporation, 1, Yawata-cho, Chikko, Sakai-shi, Osaka; Kenichi Hara, c/o Nagoya Works, Nippon Steel Corporation, 5-3, Tokai-cho, Tokai-shi, Aichi; Keiichi Yamamoto; Hikotaro Itani, both of Hiroshima Technical Institute, Mitsubishi Jukogyo Kabushiki Kaisha, 6-22, Kan-on-shinmachi 4-chome, Nishi-ku, Hiroshima-shi, Hiroshima; Atsumu Yamane, c/o Mitsubishi Jukogyo Kabushiki Kaisha, 2-5-1, Marunouchi, Chiyoda-ku, Tokyo; Akio Kasama; Isao Suichi, both of c/o R&D Laboratories -III, Nippon Steel Corporation, 1-1-1, Edamitsu, Yahatahigashi-ku, Kitakyusyu-shi, Fukuoka; Hiroyuki Kajioka, c/o R & D Laboratories-III, Nippon Steel Corporation, 1-1-1, Edamitsu, Yahatahigashi-ku, Kitakyusyu-shi, Fukuoka; Kunimasa Sasaki, c/o Hiroshima Machinery Works, Mitsubishi Jukogyo Kabushiki Kaisha, 6-22, Kan-on-shinmachi 4-chome, Nishi-ku, Hiroshima-shi, Hiroshima, all of Japan

[21] Appl. No.: 247,691

[22] Filed: Sep. 22, 1988

[30] Foreign Application Priority Data

| | | | |
|---|---|---|---|
| Sep. 24, 1987 | [JP] | Japan | 62-240479 |
| Aug. 15, 1988 | [JP] | Japan | 63-202962 |
| Aug. 15, 1988 | [JP] | Japan | 63-202963 |

[51] Int. Cl.[4] ..... B22D 11/06

[52] U.S. Cl. ..... 164/427; 164/428; 164/429

[58] Field of Search ..... 164/423, 427, 429, 463, 164/479, 428, 480

[56] References Cited

U.S. PATENT DOCUMENTS

| | | | |
|---|---|---|---|
| 1,490,944 | 4/1924 | Simpson | 72/39 |
| 1,960,958 | 5/1934 | Sargent | 428/141 |
| 2,361,039 | 10/1944 | Langel | 72/191 |
| 3,345,738 | 10/1967 | Mizikar et al. . | |
| 3,964,963 | 6/1976 | Anderson | 164/479 |
| 4,250,950 | 2/1981 | Buxmann et al. | 164/122 |
| 4,552,199 | 11/1985 | Onoyama et al. | 164/463 |
| 4,705,095 | 11/1987 | Gaspar | 164/479 |

FOREIGN PATENT DOCUMENTS

| | | |
|---|---|---|
| 635220 | 8/1936 | Fed. Rep. of Germany . |
| 60-184449 | 9/1985 | Japan . |
| 82/03575 | 10/1982 | PCT Int'l Appl. . |

*Primary Examiner*—Richard K. Seidel
*Attorney, Agent, or Firm*—Kenyon & Kenyon

[57] ABSTRACT

A cooling drum for continuous-casting machines, for manufacturing thin metallic strips, and having a surface composing part of a casting mold wall in contact with molten metal, wherein the surface has numerous dimples disposed uniformly thereon and not in contact with each other, and each of the dimples has an opening portion in the form of a circle or an oval with a diameter of from 0.1 to 1.2 mm and a depth of from 5 to 100 μm.

6 Claims, 8 Drawing Sheets

COOLING DRUM FOR CONTINUOUS-CASTING MACHINES FOR MANUFACTURING THIN METALLIC STRIP

BACKGROUND OF THE INVENTION

1. Field of the Invention

The present invention relates to a cooling drum for continuous-casting machines for producing thin metallic strip, and especially suitable for thin drum type continuous-casting machines.

2. Description of the Related Art

Currently, in the continuous casting of metals, desirably a thin strip with a shape near to that of the final product is provided, to reduce the production cost and to produce a new material. To this end, many methods have been proposed, several of which have been practiced in manufacture, but none of these methods can provide the necessary productivity and thin strip quality.

These continuous-casting methods for manufacturing thin strips include those which use a relatively simple machine structure, such as of a twin drum type using a pair of drums provided with an interior cooling system, a single drum type using a cooling drum, and a drum-belt type in which a molten metal pool is formed between a drum and a belt, etc. In these continuous-casting methods, it is important to stably provide a strip having a high quality surface, since they have been developed to produce a thin strip which can minimize the reduction rate in later rolling steps, in contrast with slabs produced by the ordinary continuous-casting machine and to be hot rolled at a high reduction ratio. Surface defects such as thickness fluctuation, if present on a thin strip, will cause surface defects on a final product and may cause an extreme impairment of the product value.

Many methods have been studied of stably obtaining a good surface quality of a cast strip.

U.S. Pat. No. 3,345,738 (issued Oct. 10, 1967) to Mizikar et al. discloses a method of producing steel strip of a uniform thickness by direct casting, in which a chill surface is brought into contact with molten steel so that a thin skin of steel solidifies thereon to create in that skin a surface pattern of distributed point indentations. To this end, a chill surface is provided with knurls formed thereon, for example, by cutting a group of parallel V-grooves and crossing them with another group of parallel V-grooves. This knurled chill surface has, however, the following essential drawbacks. The knurls are defined by the continued grooved portions along which air gaps may be continuously formed between the chill surface and the solidified skin to form the continued skin portions having a delayed solidification which will cause surface defects such as cracks. Moreover, although the solidified shell will be unified, indentations are formed on the steel strip surface and may be retained as a surface defects even after rolling.

Japanese Unexamined Patent Publication (Kokai) No. 60-184449 proposed a cooling drum having a circumferential surface provided with dimples to form air gaps as a heat insulating layer between the cooling drum and a solidified shell. The air gap lowers the heat extraction capacity of the cooling drum and the molten metal is cooled in a milder cooling condition, i.e., is more slowly cooled. This has been expected to give the solidified shell a uniform thickness over the strand width and to enable the production of a thin strip having a good shape characteristic.

The present inventors have experimentally found, however, that the expected effect can not be obtained even if uniformly disposed dimples having a predetermined depth are provided on the circumferential surface of a cooling drum and are maintained in the initial state. For example, large or continuously disposed dimples on the circumferential surface of a drum cause the formation of unevenness on the surface of a resulting thin strip, and this unevenness promotes the concentration of thermal stress which leads to surface cracking. Dimples having a linear or angular shaped opening portion provided on the circumferential surface of a drum also cause an uneven surface of a thin strip, with resulting numerous cracks, since the solidified shell is mechanically sensitive to the corners of such shaped dimples.

SUMMARY OF THE INVENTION

The object of the present invention is to provide cooling drums as a part of continuous casting machines for manufacturing a thin metallic strip in which cracking and fluctuation of the thickness are prevented, and having an excellent surface and shape characteristic.

The above object is achieved, according to the present invention, by a cooling drum for continuous-casting machines, for manufacturing thin metallic strips, having a surface composing part of a casting mold wall in contact with molten metal, wherein said surface has numerous dimples disposed uniformly thereon and not in contact with each other, and each of said dimples has an opening portion in the form of a circle or an oval with a diameter of from 0.1 to 1.2 mm and a depth of from 5 to 100 $\mu$m.

A cooling drum according to the present invention has a surface on which numerous dimples in the form of a circle or an oval are formed. When a solidified shell is formed on the surface of a cooling drum, these dimples form air gaps between the dimples and the solidified shell which are discrete or independent of each other. The portions of solidified shell on these air gaps are formed by a relatively slower cooling and have a relatively higher temperature and, in turn, a lower stiffness, in comparison with other shell portions on the drum surface sites at which dimples are not provided. Since the air gaps are discrete, the lower stiffness portions of the solidified shell are also discrete or separate from each other. The lower stiffness portions are surrounded by the higher stiffness portions of the solidified shell formed on the drum surface site without dimples through a smaller air gap distance than that of the drum surface site with dimples and at a higher cooling rate. Consequently, since the lower stiffness portions have a smaller size and are separated, the thermal stress concentration is reduced at the lower stiffness portions and cracking is also suppressed in the individual lower stiffness portions, and further cracking induced by contraction of the solidified shell cannot extend over the portions having a lower stiffness.

The provision of dimples according to the present invention thus reduces the overall cooling rate of the solidified shell, improves the overall shell evenness and suppresses the adverse effect due to the stress concentration caused by the shell unevenness at the lower stiffness portions.

DESCRIPTION OF THE PREFERRED EMBODIMENTS

Figure 5:
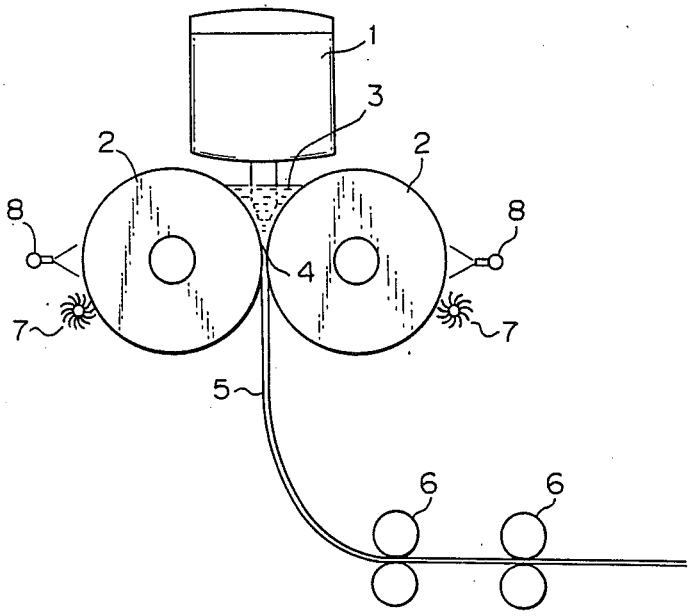
FIG. 5 shows a twin drum type continuous casting machine incorporating cooling drums according to the present invention.

FIG. 5 shows a twin drum type continuous casting machine to which the present invention is applied.

The molten metal is poured from a tundish 1 or other intermediate vessel into a liquid metal pool 3 defined by a pair of cooling drums 2 and side dams (not shown). The poured molten metal is cooled and solidified on the surface of the cooling drums 2 as heat is extracted from the molten metal by the cooling drums 2. The thus solidified shells formed on the respective surfaces of the cooling drums 2 proceed downwards with the rotation of the drums 2, are compressed together at the kissing point 4 to form a single thin strip 5, which is then forwarded through the space between the cooling drums 2. The thin strip 5 is transferred by looping toward a pinch roll 6.

Numerous dimples 11 not in contact with each other are uniformly and densely disposed on the surface of the cooling drums 2 to be in contact with the molten metal in the liquid metal pool 3, the dimples 11 having a circular opening portion with a diameter of from 0.1 to 1.2 mm and a depth of from 5 to 100 μm. The dimples 11 with a circular opening portion have no corners in a plan view of the drum surface by which cracks are generated, in contrast with dimples having a linear, a rectangular, or a flat opening portion. Oval opening portions also may be used instead of the circular portions. The oval shaped opening portion preferably has a minor-to-major diameter ratio of 0.6 or greater. The minor and the major diameters are both within the range of from 0.1 to 1.2 mm. The term "diameter" used throughout the specification denotes both the "minor diameter" and the "major diameter".

Dimples having a diameter of the opening portion of less than 0.1 mm have not significant mitigating effect on the cooling and are difficult to clean, easily disappear when scratched, knocked or filled with dirt, and are difficult to form. On the other hand, dimples having a diameter of the opening portion greater than 1.2 mm tend to cause micro-cracking and form numerous fine projections on the thin strip.

When the depth of the dimples is less than 5 μm, air gaps formed at the dimples have a very small effect on the heat insulation. Moreover, the molten metal will touch the dimple bottom and solidify quickly, forming numerous fine spikes on a thin strip, with a resulting undesirable quality of the final product.

When the depth of dimples is greater than 100 μm, provided that the opening portion has a diameter of 1.2 mm or less, a further effect cannot be obtained but the surface toughness of drum is lowered to increase the drum surface wear.

Figure 2:
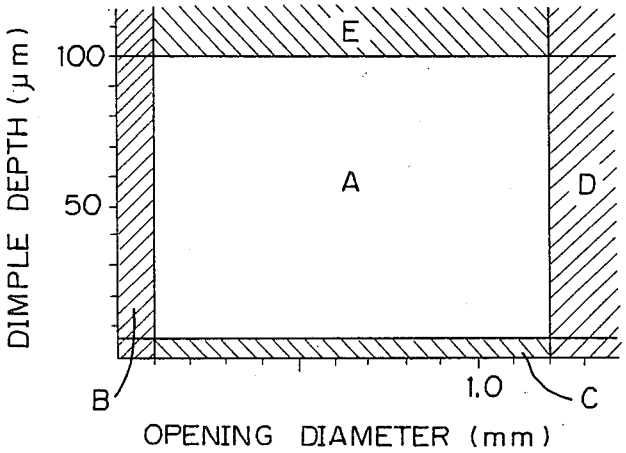
FIG. 2 shows the influence of the dimple size on the surface of a thin strip.

FIG. 2 shows the influence of the opening diameter and the dimple depth on the surface of a thin strip.

When casting a thin strip by using a cooling drum provided with dimples having an opening diameter and depth falling within the region A of FIG. 2, the obtained thin strip has a relatively smooth surface and no adverse effect by the dimples is observed. With a cooling drum provided with dimples of the region B or C, sufficient air gaps cannot be ensured and a mild cooling effect is not obtained, with the result that the obtained strip has a concavity and continued cracks which are typically found in severely cooled strips. For a cooling drum with dimples of the region D, the molten metal fills up the dimples and the dimpled pattern on the drum surface is transcribed on the cast strip surface and retained as defects even after the subsequent rolling. A cooling drum with dimples of the region E results in a strip surface comparable to that of the dimples of the region A, but the dimple shape changes during casting, and a long term casting cannot be successfully performed.

A cooling drum according to the present invention is preferably provided with dimples having an opening portion diameter of from 0.3 to 0.7 mm and a depth of from 10 to 30 μm.

In the present invention, the shape and the distribution mode of the dimples significantly influences the formation of desired air gaps, and accordingly, a high precision is required when working the dimples. The dimples according to the present invention are preferably formed by etching, electric spark forming, plasma forming, electric beam forming, laser beam forming or the like, instead of by ordinary machining.

Figure 1:
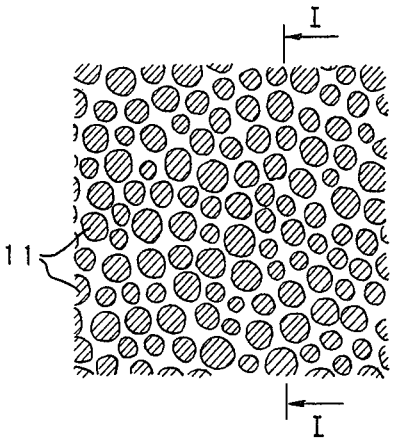
FIG. 1 shows a plan view of dimples disposed uniformly on the surface of a cooling drum according to the present invention.
Figure 3:
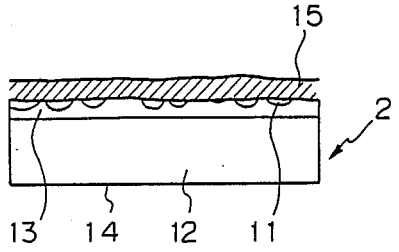
FIG. 3 shows a section taken along the line I—I of FIG. 1.

FIG. 3 is a sectional view taken along the line I—I of FIG. 1, and shows the surface region of a cooling drum on which dimples are formed by such a forming procedure. The cooling drum 2 has a sleeve 12 of alloyed steel on which a nickel plated layer 13 is formed, and the dimples 11 are formed on the layer 13 by any of the above-mentioned forming procedures. The rear surface of the sleeve 12 opposite to the dimples 11 is water-cooled.

At the later solidification stage, i.e., when the solidified shell has grown to a certain extent, the shell 15 formed on the surface of the cooling drum 2 is directly in contact with the surface of the drum 2 at the drum portions without dimples 11 and facing the surface of the drum 2 through the air gaps. These air gaps cause the aforementioned mild cooling effect. This situation allows the cooling capacity of the cooling drum 2 to be controlled by adjusting the ratio of the area occupied by the air gaps in the entire circumferential surface area of the drum 2 or the contact area ratio of the solidified shell 15 to the entire drum surface area.

Figure 4:
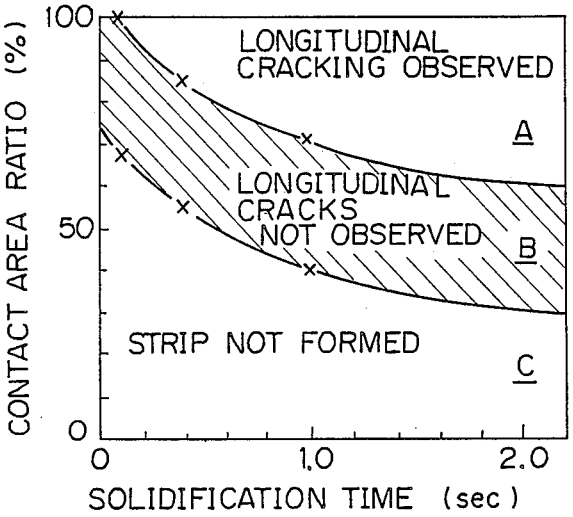
FIG. 4 shows the influence of the solidification time and the contact area ratio of the cooling drum on the longitudinal cracking of a thin strip.

FIG. 4 shows the occurrence of longitudinal cracking with respect to the contact area ratio of the solidified shell 15 on the entire circumferential surface area of the cooling drum 2 and to the solidification time or the time elapsed from the first contact of molten metal with the drum 2 to the parting of the molten metal from the drum 2. A longer solidification time results in a greater thickness of thin strip upon parting.

For a given solidification time, a cooling drum 2 having dimples at a contact area ratio falling within the hatched region of FIG. 4 allows the production of a thin strip with a sound surface while ensuring a desired thickness. When a relatively thicker strip is desired, a longer solidification time is required, and consequently, the surface temperature of the strip is lowered. Thermal contraction due to this temperature drop induces a high tensile stress on the strip surface to cause cracking at relatively weaker portions of the strip surface, as shown by the region A of FIG. 4. To avoid this cracking upon production of a relatively thicker strip, a lower contact area ratio is selected as shown by the region B, to reduce the heat flux from the thin strip to the drum surface and ensure a mild cooling of strip. This eliminates the large drop of the strip surface temperature, reduces the thermal contraction of the strip surface, and prevents cracking. Nevertheless, as shown by the region C, if the contact area ratio if too small, a thin strip, when leaving the drum, does not have sufficient strength over the entire surface thereof and cannot prevent breaking by itself.

During the production of thin strips by using a cooling drum 2 provided with dimples 11 according to the present invention, oxides, impurities and other foreign substances may often be deposited on and adhere to the dimples 11, and thus reduce the effect by dimples. A cleaning brush 7 is preferably provided facing the cooling drum surface to remove the deposits adhered to the dimples 11 as well as other portion of the drum surface. A drum coating material mainly composed of zircon, alumina or the like may preferably be applied to the cleaned surface of drum by a drum coater 8, to further improve the strip quality and to extend the drum life.

The cooling drum according to the present invention can prevent cracking of the thin strip, particularly a large scale cracking such as 100 mm or greater, which is unavoidable in the conventional thin strip manufacture with the aforementioned prior art cooling drum and is detrimental to the final product quality.

The cooling drum according to the present invention can also prevent smaller size cracks by further controlling the dimple opening portion diameter and the inter-dimple distance within a proper range, to further improve the final product quality.

This can be achieved, according to a more advantageous embodiment of the present invention, by a cooling drum for continuous-casting machines for manufacturing thin metallic strips, having a surface composing part of a casting mold wall in contact with molten metal, wherein said surface has numerous dimples disposed uniformly thereon and not in contact with each other, and each of said dimples has an opening portion in the form of a circle or an oval with a diameter of from 0.1 to 1.2 mm and a depth of from 5 to 100 $\mu$m, and these dimples are disposed so that the dimple diameter (D) and the distance (L) between dimples have a relationship expressed by the following formula:

$$0.05D + 0.1 \leqq L \leqq \begin{cases} 1.4D + 0.5, \text{ when } 0.1 \leqq D \leqq 0.5 \text{ or} \\ 1.2, \text{ when } 0.5 \leqq D \leqq 1.2. \end{cases}$$

Figure 6:
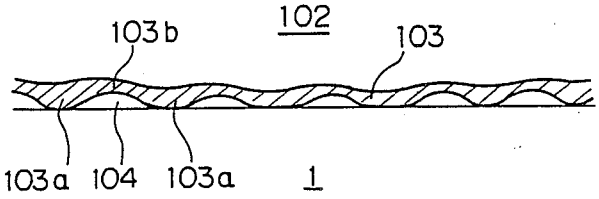
FIG. 6 typically shows the wavy formation of the solidified shell on the conventional smooth drum surface not having dimples.

FIG. 6 schematically illustrates the growth of the solidified shell on the smooth surface of an ordinary cooling drum without dimples.

The molten metal 102 is brought into contact with the circumferential surface of a cooling drum 1 and cooled by heat extraction through the drum 1 to form a solidified shell 103. The solidified shell at portions at which a higher cooling effect is felt grows faster to form a relatively thicker shell 103*a*, and the solidified shell at portions at which a lower cooling effect is felt grows slower to form a relatively thinner shell 103*b*, which has a lower strength in comparison with that of the thicker shell 103*a* and causes stress concentration at the thinner shell 103*b*. The solidification contraction of the thicker shell 103*a* the thinner shell 103*b* away from the drum and thus air gaps 104 are formed between the drum surface and the shell 103. These air gaps act as a heat insulating layer to further lower the growth rate of the thinner shell 103*b* and cracking, including small scale cracks, in such thinner shells 103*b* may occur.

In the more advantageous embodiment of the present invention, cracking including smaller scale cracks also can be prevented by controlling the dimple opening portion diameter and the inter-dimple distance, to rationalize the mutual relationship between the solidified shell and the air gap.

Figure 7:
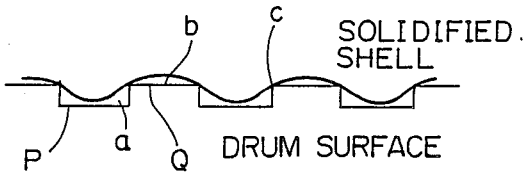
FIG. 7 shows the relationship between the solidified shell and a dimpled drum surface according to the present invention.

The optimum relationship between the shell and air gap is obtained under the following conditions:

(A) Upon the initial contact of the molten metal with the drum surface, the molten metal bows out into the dimple due to the surface tension thereof, the early solidified shell being constrained by the edge "C" as shown in FIG. 7 to ensure a uniform cooling.

(B) As shown in FIG. 7, air gaps "a" and "b"are formed in the dimples "P" and on the neighboring hills, "Q", respectively, to ensure the mild cooling and thereby mitigate the stress induced by thermal distortion.

Figure 8:
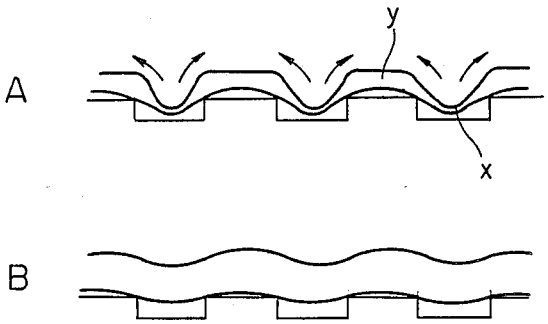
FIGS. 8A and 8B show the positional change of the solidified shell from the early solidification stage (A) to the later solidification stage (B)

(C) After the solidification has proceeded to a certain extent, as shown in FIG. 8A, a bowed shell portion "x" formed during the earlier solidification from the bowed molten metal by the mild cooling has a lower resistance to deformation, due to a higher temperature thereof in comparison with the neighboring shell "y", and is subsequently pulled by the shell "y" in the direction shown by arrows because of the thermal contraction due to a further drop in temperature, to finally form a smooth shell surface as shown in FIG. 8B.

Figure 9:
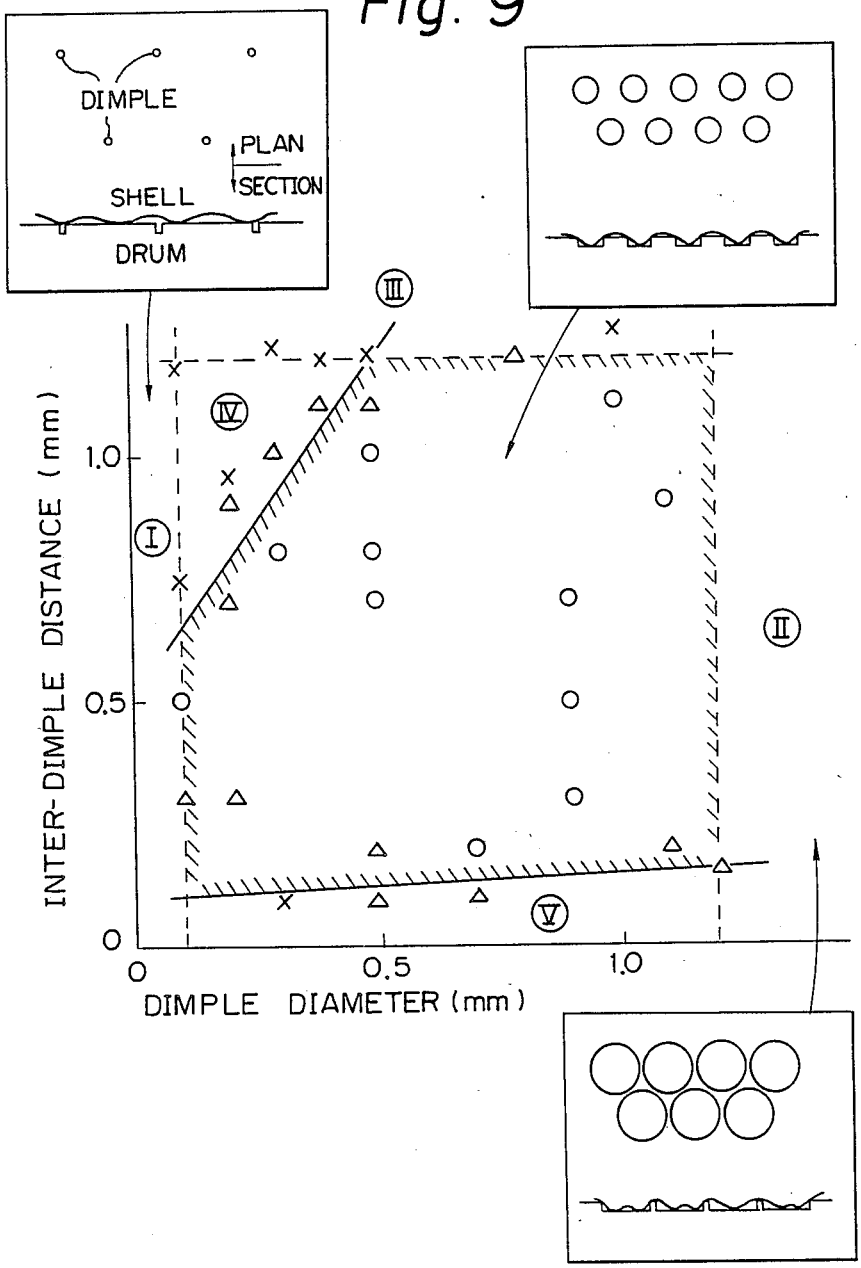
FIG. 9 shows the cracking index with respect to the dimple diameter D and the inter-dimple distance L.
Figure 10:
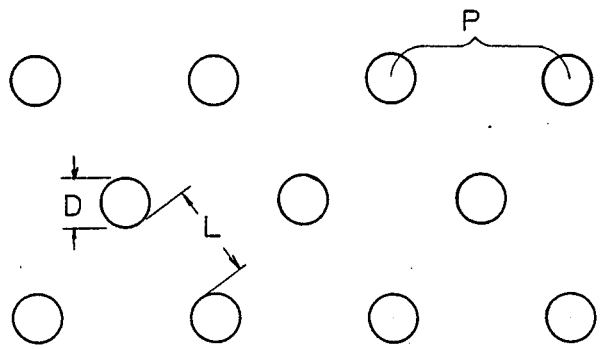
FIG. 10 shows the dimple diameter D and the inter-dimple distance L.

FIG. 9 shows the relationship between the dimple diameter (=opening diameter) D and the inter-dimple distance L, where D and L are measured for dimples "P" in the manner shown in FIG. 10.

For dimples with an extremely small diameter ($D<0.1$ mm, FIG. 9, region I), the molten metal cannot bow into the dimples, resulting in a poor contact of the molten metal with the drum surface and, in turn, an insufficient constraint of the solidified shell by the dimples, which leads to a separation of the solidified shell from the drum surface whereby a uniform cooling of the shell cannot be established, and consequently, the effect of the dimples cannot be obtained.

When the dimple diameter D is extremely large ($D > 1.2$ mm, FIG. 9, region II), the diameter is greater than the size of air gaps which would be formed on the dimple-free, smooth drum surface and large air gaps, instead of small air gaps, "a" of FIG. 7, are formed inside the individual dimples and the bowed molten metal tends to remain inside the dimples. This cannot provide uniformly dispersed small air gaps nor ensure a uniform cooling of the solidified shell, and consequently, the mild cooling effect of the dimples cannot be obtained.

A similar situation is brought about by an extremely large inter-dimple distance ($L > 1.2$ mm, FIG. 9, region III), in which the inter-dimple distance L is greater than the size of air gap which would be formed on the dimple-free smooth drum surface and large air gaps, instead of the small air gaps "b" of FIG. 7, are formed on the hills surrounding the dimples. Again this cannot provide uniformly dispersed small air gaps nor ensure a uniform cooling of the solidified shell, and consequently, the effect of the dimples cannot be obtained.

Therefore, to obtain the dimple effect, the dimple diameter D and the inter-dimple distance L must fall within the ranges expressed by;

$$0.1 \leqq D \leqq 1.2 \text{ (in mm), and } L \leqq 1.2 \text{ (in mm),}$$

as shown in FIG. 9 by three broken lines.

Further, for the region of $D < 0.5$ mm, it is difficult for the molten metal to bow into the dimples and the constraint of the solidified shell by the dimple edge is too weak. Moreover, when the inter-dimple distance L is large, the constraint of the solidified shell by the dimples is further weakened to cause a separation of the shell from the dimples due to shell contraction at the later solidification stage, and a uniform cooling of shell is not maintained. Experiment has proved that this phenomenon occurs under the condition of $L > 1.4D + 0.5$ (upper solid line of FIG. 9), which corresponds to the region IV of FIG. 9. Consequently, in this region of D and L, the dimple effect cannot be obtained.

When the inter-dimple distance is extremely small, the molten metal is brought into too close a contact with the hills surrounding the dimples, and the air gaps "b" of FIG. 7 are not formed. This cannot provide uniformly dispersed small dimples. Experiment has proved that this phenomenon occurs under the condition of $L < 0.05D + 0.1$ (lower solid line of FIG. 9), which corresponds to the region V of FIG. 9. Consequently, in this region of D and L, the dimple effect cannot be obtained.

To summarize the above-mentioned conditions, the following relationship is required to obtain the dimple effect:

$$0.05D + 0.1 \leqq L \leqq \begin{cases} 1.4D + 0.5, \text{ when } 0.1 \leqq D \leqq 0.5 \text{ or} \\ 1.2, \text{ when } 0.5 \leqq D \leqq 1.2. \end{cases}$$

Continuous-casting by using a cooling drum with dimples specified by this relationship restricts the growth mode of the solidified shell on the drum circumferential surface to provide a thin strip free from even small scale cracking and having a high quality.

A practical application of the cooling drum according to this advantageous embodiment will be described below.

A usual twin-drum type continuous casting machine provided with a pair of drums 1 was used. The molten metal was poured between these drums 1 to form a liquid metal pool and the solidified shells grown on the respective drum surfaces were compressed to form a thin strip at a kissing point.

The molten metal had a chemical composition of a stainless steel and was poured at a temperature of 1500° C. The casting speed was 65 m/min and a 2.4 mm thick 800 mm wide thin strip was produced.

Surface cracking of the thus-obtained thin strip was observed with respect to the dimple diameter D and the inter-dimple distance L. The results are plotted in FIG. 9, where the symbol "o" corresponds to the cracking index of 1 cm/m or less, "Δ" the index less than 20 cm/m, and "x" the index of 20 cm/m or more; the cracking index is the total length (cm) of the longitudinal cracks observed on the unit length (1 m) of the thin strip in the casting direction.

The results show that substantially no cracking occurs within the region of D and L according to the advantageous embodiment of the present invention.

The most advantageous region of D and L for minimizing cracking is $0.3 \leqq D \leqq 0.7$ mm and $0.5 \leqq L \leqq 0.9$ mm.

Another advantageous embodiment according to the present invention also can prevent cracking, including small scale cracking, to the same extent as in the above-mentioned embodiment.

This is achieved, according to the present invention, by a cooling drum for continuous-casting machines, for manufacturing thin metallic strips, having a surface composing part of a casting mold wall in contact with molten metal, wherein said surface ha numerous dimples disposed uniformly thereon and not in contact with each other, and each of said dimples has an opening portion in the form of a circle or an oval with a diameter of from 0.1 to 1.2 mm and has a depth of from 5 to 100 μm; said dimples are disposed so that a density of the dimples on said surface is cyclically varied in a wave mode along the drum axis and/or along the drum circumference, the wavy cyclic variation having a wave length of from 5 to 40 mm and a wave height of from 10 to 30% in terms of the difference between the peak and the bottom percentages of the area occupied by the dimples on the drum surface.

This embodiment is particularly effective for preventing cracking, including small scale cracking, typically of strips of steels in which a transformation occurs during solidification, such as JIS SUS 304 stainless steel. In these steels, macroscopic stress concentration is dispersed and relatively large scale cracking is prevented by dimples uniformly distributed on the drum surface, but from the microscopic viewpoint, small scale cracking occurs due to a cyclic small wave (about 10 to 50 mm) of the solidified shell, which is considered to be caused by the delta-to-gamma transformation stress of stainless steel.

To suppress this wavy deformation of the solidified shell, and the small scale cracking, dimples are disposed in a cyclic distribution on a cooling drum to control the cyclic occurrence of the thicker and the thinner shells growing on the cooling drum surface.

The wavy variation of the dimple density must have a wave length of from 5 to 40 mm, since the wavy deformation of the solidification shell mainly has a wave length of from 10 to 50 mm as mentioned before, and to suppress this deformation wave by distributing dimples cyclically, at least two waves of the dimple density variation must exist within a single wave of the shell deformation which would occur on the dimple-free smooth drum surface.

Figure 11:
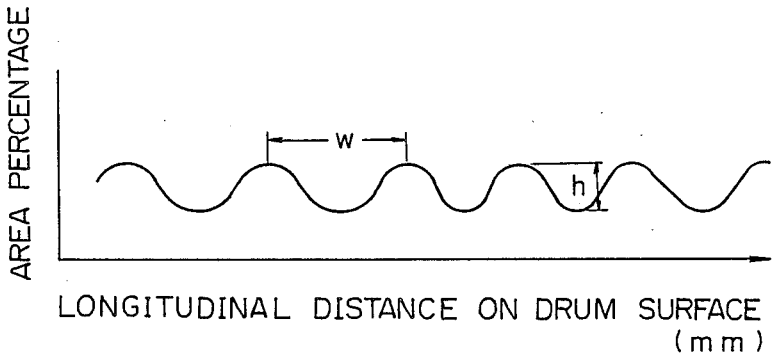
FIG. 11 shows an example of a wavy variation mode of the dimple density or the dimple area ratio.

The wavy variation of the dimple density also must have a wave height of from 10 to 30% in terms of a change of the area occupied by the dimples on the drum surface, since a wave height, i.e., change of the area percentage, outside this range is less effective. That is, if the cyclic dimple density variation effect is lowered, either the change is smaller or greater than the specified range. The wave length, W and the wave height, h may be mainly in a sine curve type relationship as shown in FIG. 11, but it has been proved by experiment that other type of continuous functions also may be adopted.

Figure 12A:
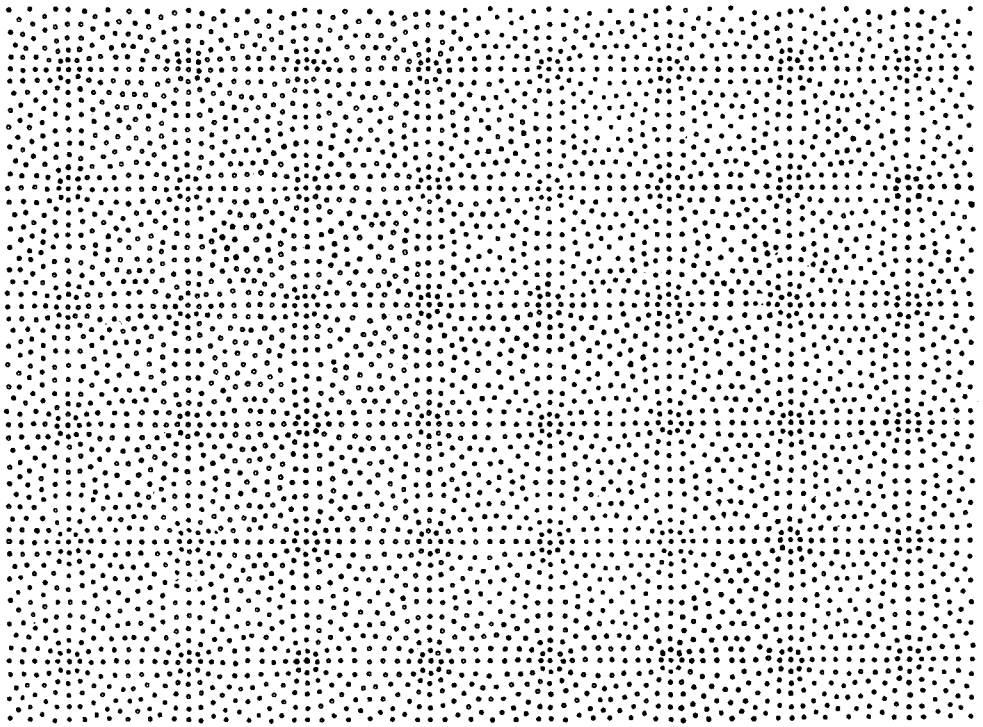
FIGS. 12A and 12B show typical examples of the cyclic distribution patterns of the dimple density or the dimple area ratio.
Figure 12B:
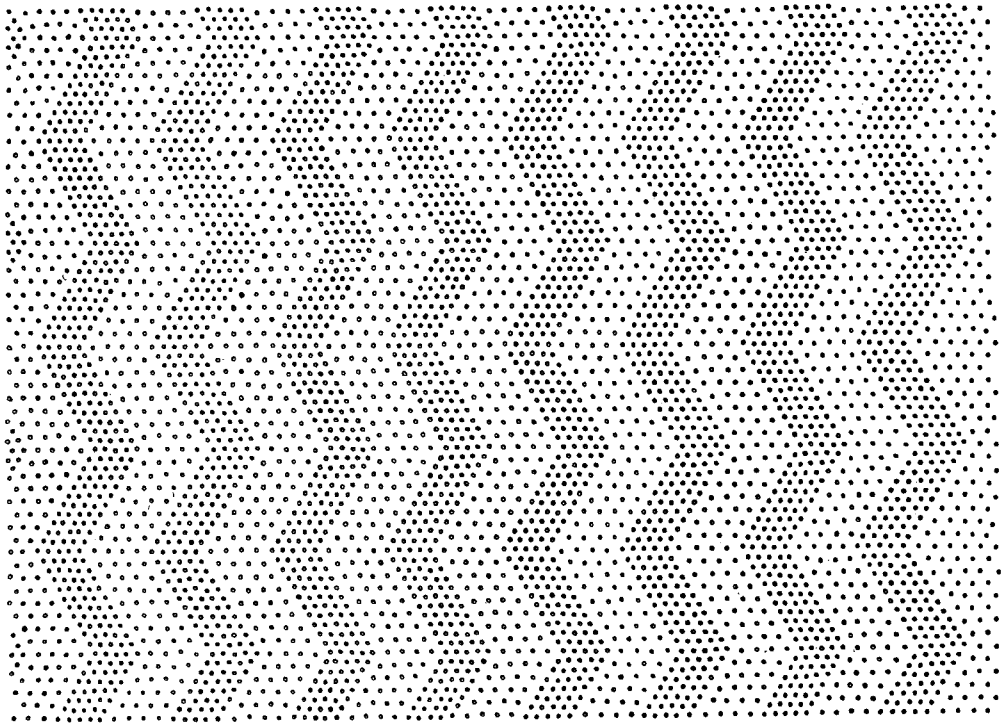

FIGS. 12A and 12B show examples of the dimple distribution pattern provided on the drum circumferential surface. The drum axis lies in the left-right line in the drawing. In FIG. 12A, the area percentage of dimples is varied in the axial and the circumferential directions at a cycle (wave length) of 20 mm and at an area percentage change (wave height) of 15% between the peak percentage of 30% and the bottom percentage of 15%.

The area percentage of dimples is defined as follows. Within an area covering at least one cycle of the dimple area percentage variation, measuring points are set at intervals of 1 mm. The area percentage occupied by the dimples is measured in a sequence area of 2 mm×2 mm surrounding one selected measuring point. The thus measured value is defined as the area percentage of dimples for the selected measuring point. The measuring procedure may be performed with an image processing apparatus or the like.

In FIG. 12B, the area percentage of dimples is varied in the drum axis direction at a cycle of 15 mm and at an area percentage change of 30% between the peak percentage of 40% and the bottom percentage of 10%. For the circumferential variation, several regions of a relatively greater area percentage are inserted to avoid the continuation of regions of a small area percentage. This insertion is not essential to obtain the dimple effect. A minute fluctuation of area percentage is also provided in the circumferential direction. In FIGS. 12A and 12B, the dimples have a depth of 30 μm and an opening portion in the form of a circle with a diameter of 0.5 mm.

In the same procedure as in the aforementioned first advantageous embodiment, a thin strip of stainless steel was produced by incorporating the cooling drums provided with dimples in these cyclic distributions according to the second advantageous embodiment of the present invention.

The cracking indexes measured for this strip are summarized in Table 1, including those for two thin strips produced by using a dimple-free, smooth drum and a drum provided with dimples merely in a uniform distribution not satisfying the conditions of the first or the second embodiment.

TABLE 1

| Drum Surface | Cracking Index (cm/m) |
|---|---|
| Smooth | 200 to 300 |
| Dimples, Uniformly Distributed | 10 to 30 |
| Dimples, Cyclically Distributed; FIG. 12 A | 0 |
| Dimples, Cyclically Distributed; FIG. 12 B | 0 |

Table 1 shows that the first thin strip continuously cast by using a smooth cooling drum contained numerous cracks, including large cracks. The second thin strip was produced according to the present invention by using a cooling drum provided with dimples having a depth of 30 μm and an opening portion in the form of a circle with a diameter of 0.5 mm, and distributed uniformly and not in contact with each other. The second drum lowered the cracking index to one tenth or less in comparison with the first strip produced with a smooth drum, but a few small cracks were still present on the strip. The third and the fourth thin strips were produced according to the second embodiment by using the cooling drums provided with dimples cyclically distributed as shown in FIGS. 12A and 12B, respectively, and contain substantially no cracks. Thus, it can be clearly understood that the cyclic distribution of the dimple density can suppress cracking and further improve the thin strip quality

We claim:

1. A cooling drum for continuous-casting machines for manufacturing thin metallic strips, and having a surface composing part of a casting mold wall in contact with molten metal, wherein said surface has numerous dimples disposed uniformly thereon and not in contact with each other, and each of said dimples has an opening portion in the form of a circle or an oval with a diameter of from 0.1 to 1.2 mm and a depth of from 5 to 100 μm.

2. A cooling drum according to claim 1, wherein said opening portion has a minor-to-major diameter ratio of 0.6 or greater.

3. A cooling drum according to claim 1, wherein each of said dimples has an opening portion in the form of a circle or an oval with a diameter of from 0.3 to 0.7 mm and has a depth of from 10 to 30 μm.

4. A cooling drum according to claim 1, wherein said dimples are disposed so that said diameter (D) and distance (L) between the dimples have a relationship expressed by the following formula:

$$0.05D + 0.1 \leqq L \leqq \begin{cases} 1.4D + 0.5, \text{ when } 0.1 \leqq D \leqq 0.5 \text{ or} \\ 1.2, \text{ when } 0.5 \leqq D \leqq 1.2. \end{cases}$$

5. A cooling drum according to claim 4, wherein said diameter (D) is from 0.3 to 0.7 mm and said distance (L) between the concavities is from 0.5 to 0.9 mm.

6. A cooling drum according to claim 1, wherein said dimples are disposed so that a density of the dimples on said surface is cyclically varied in one of a wave mode along the drum axis and along the drum circumference, the wavy cyclic variation having a wave length of from 5 to 40 mm and a wave height of from 10 to 30% in terms of a difference between peak and bottom percentages of an area occupied by said dimples on said drum surface.

* * * * *